US005752806A

United States Patent [19]

Frey et al.

[11] Patent Number: 5,752,806

[45] Date of Patent: May 19, 1998

[54] METHOD OF REDUCING NOISE FROM THE FLOW OF GASEOUS MEDIA IN A SINGLE ROTATION MACHINE USING A BYPASS FOR COMPRESSION CONTROL

[75] Inventors: Michael Frey, Lindau, Germany; Frank Obrist, Dornbirn, Austria

[73] Assignee: TES Wankel Technische Forschungs-und Entwicklungsstelle Lindau GmbH, Lindau, Germany

[21] Appl. No.: 169,748

[22] Filed: Dec. 17, 1993

Related U.S. Application Data

[62] Division of Ser. No. 40,635, Mar. 31, 1993, abandoned.

[30] Foreign Application Priority Data

Apr. 1, 1992 [CH] Switzerland ..... 01 049/92

[51] Int. Cl.[6] ..... F04C 29/10; F04C 18/10

[52] U.S. Cl. ..... 417/53; 417/440

[58] Field of Search ..... 418/167, 168, 418/169; 417/440, 53

[56] References Cited

U.S. PATENT DOCUMENTS 1,624,099 4/1927 Haight ..... 418/169 X 2,785,637 3/1957 Nübling ..... 418/167 X 5,147,194 9/1992 Kuhn et al. ..... 418/168

FOREIGN PATENT DOCUMENTS 3911541 3/1990 Germany .

*Primary Examiner*—Richard E. Gluck

*Attorney, Agent, or Firm*—Ladas & Parry

[57] ABSTRACT

The internally axed single-rotation machine has inlet and outlet channels (5, 6), which extend arcuately round the circular cylindrical housing space (11) enclosing the rotors (1, 2) to such an extent that the tangentially connecting inlet and outlet connections (12, 13) cross and the outlet channel (6) extends over part of the inlet channel (5). In the vicinity of this approach between the outlet and inlet channels (6, 5) there is a flow connection (19), which continues the arcuate shape of the outlet channel (6) to that of the inlet channel (5). The gas pressure in the outlet channel (6) is variable by a control element (20) located in said flow connection (19). The single-rotation machine pressure control is associated with minimum noise generation and minimum flow losses and a particularly compact construction is obtained.

8 Claims, 5 Drawing Sheets

METHOD OF REDUCING NOISE FROM THE FLOW OF GASEOUS MEDIA IN A SINGLE ROTATION MACHINE USING A BYPASS FOR COMPRESSION CONTROL

This application is a division of Ser. No. 08/040.635 filed Mar. 31, 1993, now abandoned.

BACKGROUND OF THE INVENTION

The invention relates to an internal axis rotary piston machine for the compression of gaseous media. It includes rotors rotating about fixed axes and which are sealingly surrounded by a common housing. The rotors form between them, by their reciprocal engagement, working spaces having a variable size. Inlet and outlet channels are provided in the housing, which connect the working spaces with inlet and outlet connections on the housing and in which, for pressure control purposes between the inlet and outlet channel, there is provided a flow connection having a control element therein.

Single-piston machines for gaseous media are suitable for very high rotor rotational speeds, so that they can offer high efficiencies in small dimensions. This is made possible by mounting their rotors about fixed rotation axes. However, the high rotor speeds lead to considerable noise generation, because the inflowing gaseous medium is suddenly accelerated to the high rotational speed of the rotors, is compressed and subsequently decelerated to the outflow speed again. Non-uniform flow guides and sudden deflections of the gas flow in the inlet and outlet channels contribute to the noise generation and more particularly result from the pressure control devices used in know constructions.

U.S. Pat. No. 4,943,213 discloses an internal axis rotary piston machine of the aforementioned type, whose parallel inlet and outlet connections are interconnected by a traverse channel for pressure control purposes and which can be closed by a control angled flow resistance and noise-generating deflections and leads to an increased noise level, because over its length an oscillating gas column occurs. In addition, such a pressure control device leads to an increase in the construction volume of the single-piston machine.

DE-A-39 11 541 discloses an internal axis rotary piston machine control device, which has an additional return line passing round the machine housing and whose inflow-side end is controlled by a drum controller. Consequently, the return part of the gas flow to the suction side of the single-piston machine leads to a sharp deflection and a long flow path. As a result, this pressure control method leads to considerable flow losses, to noise generation over the length of said return line and to an increase in the installation space required for the single-rotation machine.

SUMMARY OF THE INVENTION

The object of the present invention is to provide a single-rotation machine of the aforementioned type, which with limited constructional expenditure and effort and without increasing the installation space for the machine, permits low-loss and low-noise control of the pressure in the outlet connection.

According to the invention, the inlet and outlet connections are reciprocally displaced on the housing parallel to the rotation axis of the rotors, at least one of the inlet and outlet channels is arcuate, surrounds the circular cylindrical housing space up to the associated inlet or outlet connection and approaches the other channel (6,5), the flow connection with the control element being located in the vicinity of this approach.

DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

It is obvious that the invention can be realized on any single-piston machine of the aforementioned type nd the literature provides numerous examples of such machines.

Figure 1:
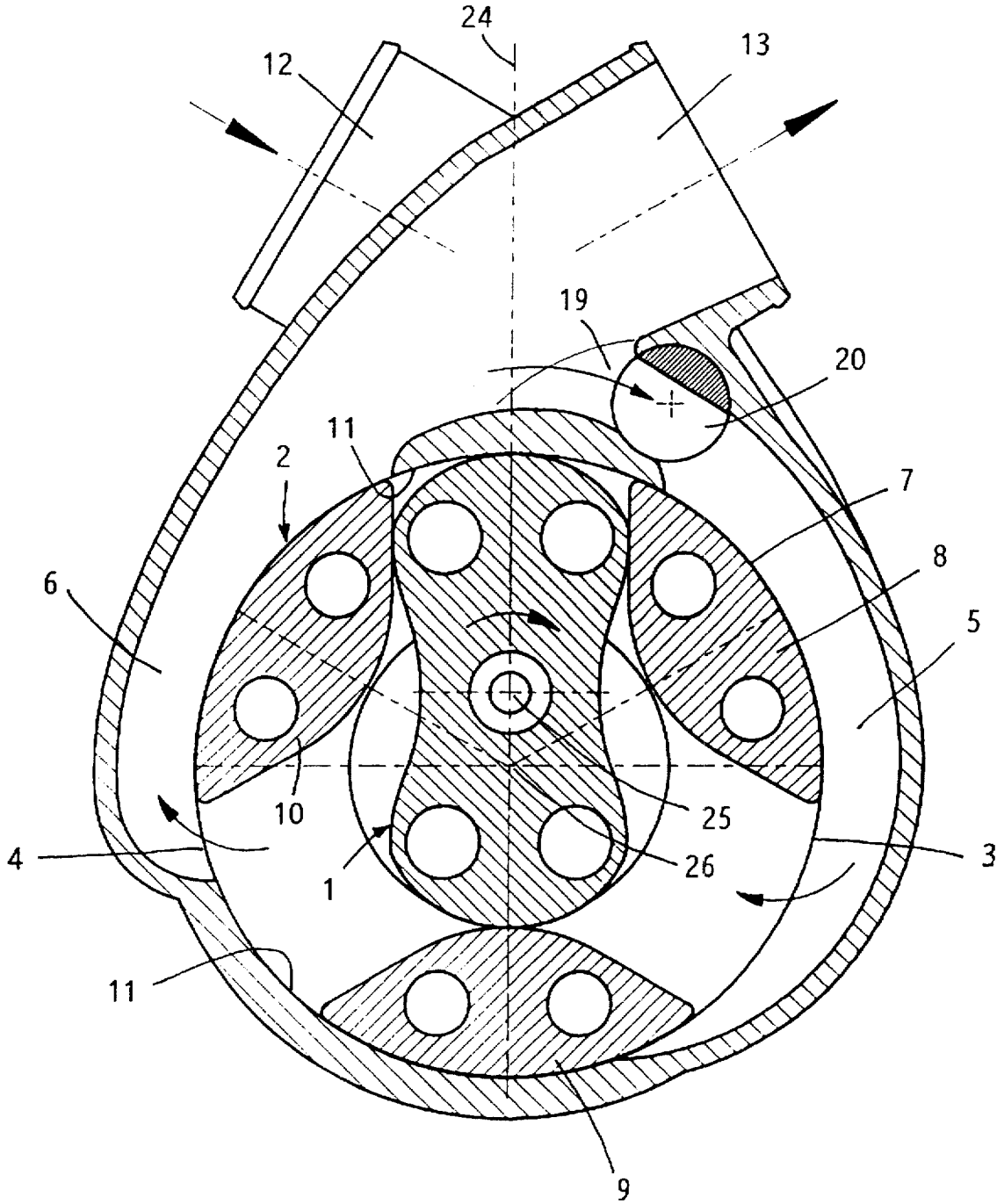
FIG. 1 A radial section through an internal axis rotary-piston machine according to the invention in a plane containing the outlet connection axis.

Turning to the Figure SX, the circular cylindrical housing spece 11, in which rotate the rotors, 1, 2, has on two radially facing sides, which in each case, have an opening whose size is circumferentially variable through the rotary movement of the rotors (1, 2) and which form the inflow and outflow openings (3, 4) and therefore the connection to the inflow and outflow channels (5, 6). FIG. 1 shows how the inflow and outflow openings 3, 4 are directly controlled by the rotary movement of the rotors 1, 2. Thus, during each movement phase, the inflow and outflow channels 5, 6 are radially inwardly defined in each case at least partly by the cross-sectionally arcuate circumferential surface 7 of one of the engagement parts 8, 9, 10 of the external rotor 2.

The inflow and outflow channels 5, 6 of the machine arcuately surround these openings defined by the movement of the rotors 1, 2 and the circular cylindrical housing space 11 corresponding to the movement space of the rotors 1, 2, so that the gas flows approximately tangentially in and out in the rotation direction of the rotors 1, 2. This flow control or guidance is not only advantageously hydraulically, but it also permits a space-saving machine construction. A compact construction is necessary so as to be able to install the single-piston machine in the engine chamber of a motor vehicle, so that it can be used there for supercharging the combustion air.

The inflow and outflow channels 5, 6 partly surround the rotors 1, 2 and their movement space, but also have tangentially arranged connections 12, 13 on the housing which project past one another in a crossing manner in different planes. The resulting axial displacement of the connections 12, 13 from a conventional, axial central position advantageously also leads to a stepped length and different axially directed curvature of preferably juxtaposed partial channels 5*a*, 5*b*, 5*c* of the inlet channel 5. These are obtained by wall-forming separating ribs 17, 18 directed radially to the rotation axes of the rotors 1, 2 shown in FIG. 4 with reference to partial channels 6*a*, 6*b* and 6*c*.

Figure 4:
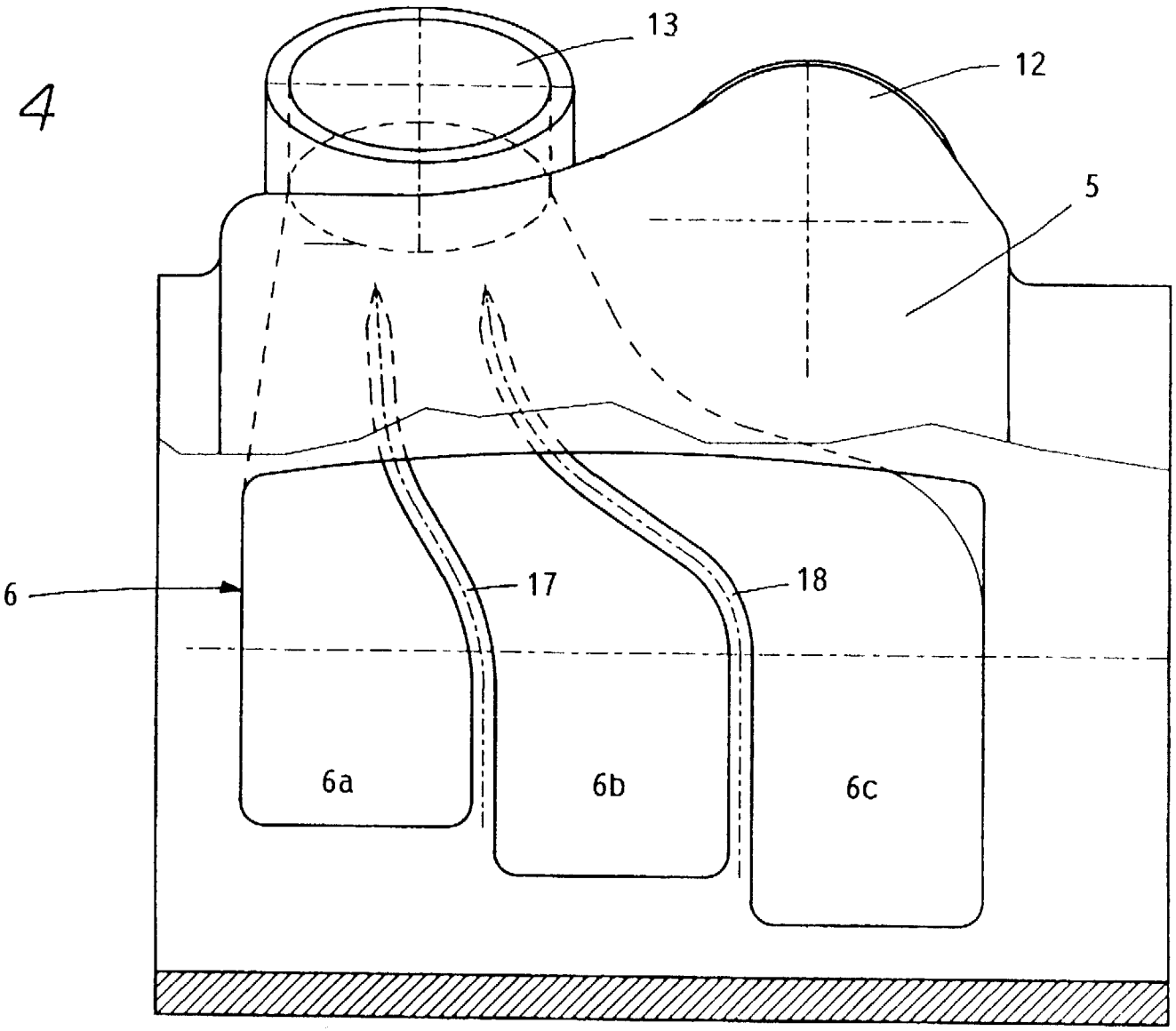
FIG. 4 A part axially section side view, at right angles to the axial direction of the machine housing according to FIG. 3.

The partial channels 6*a*, 6*b*, 6*c* of the facing channel 6 visible in FIG. 4 are curved by an oppositely directed curvature of their separating ribs 17, 18 connecting to the ribs for channels 5*a*, 5*b* and 5*c*, therefore, that the deflection of the flow, for the same view directed transversely to the machine axis, is directed from right to left instead of from left to right and consequently there are differently long flow paths up to the associated connections 12, 13.

The subdivision of the gas flow into partial channels 6*a*, 6*b* and 6*c* on the outflow side of the machine, immediately adjacent to the rotors 1, 2 and the recombination thereof in the vicinity of the connection 13, as well as the subdivision and recombination of the gas flow on the inlet side of the single-piston machine, through the differently long flow paths and differently long durations of the sound waves, leads to a significant noise reduction directly at the place of origin of the noise within the machine.

Figure 2:
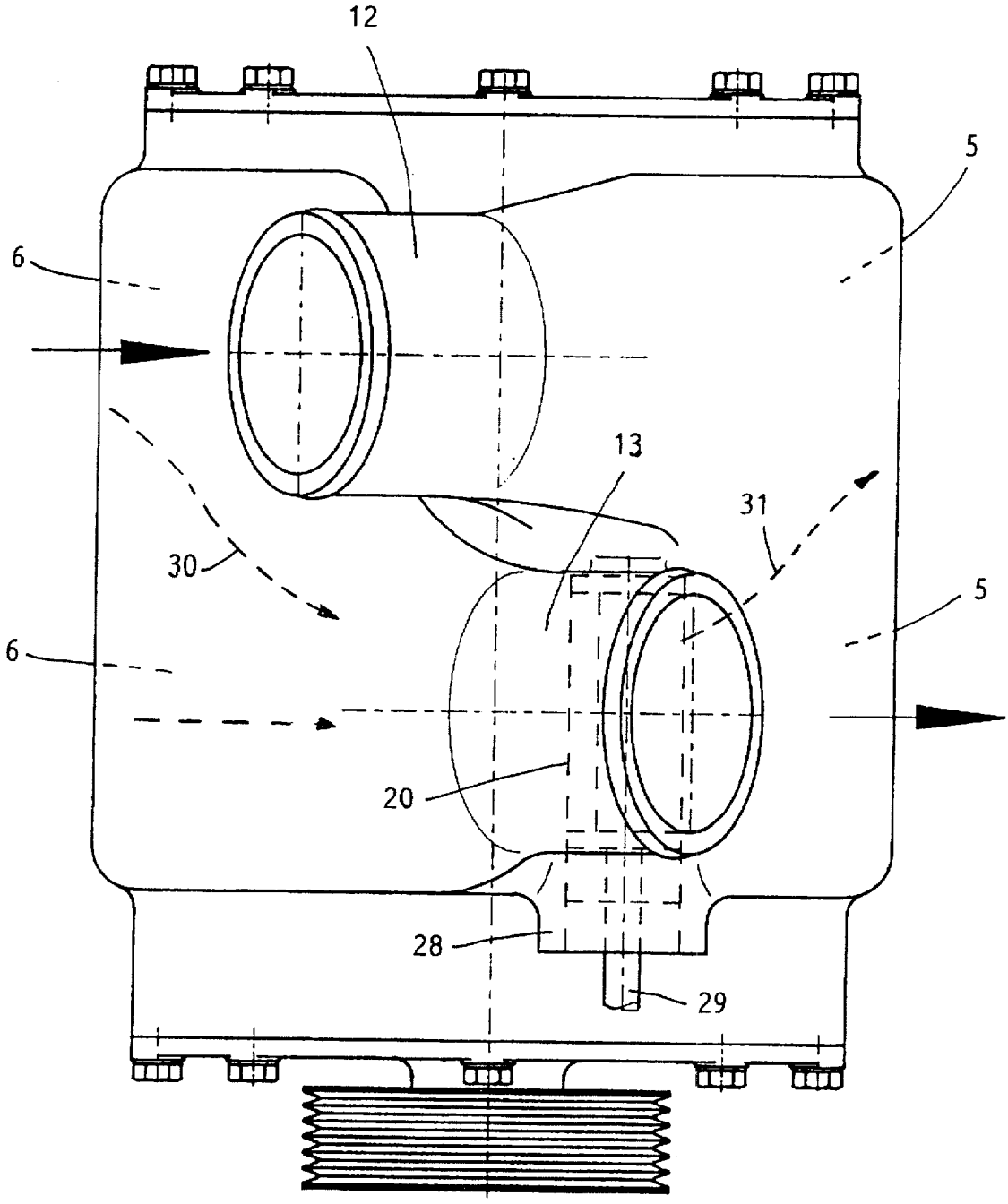
FIG. 2 A plan view of the rotary piston machine according to FIG. 1.
Figure 3:
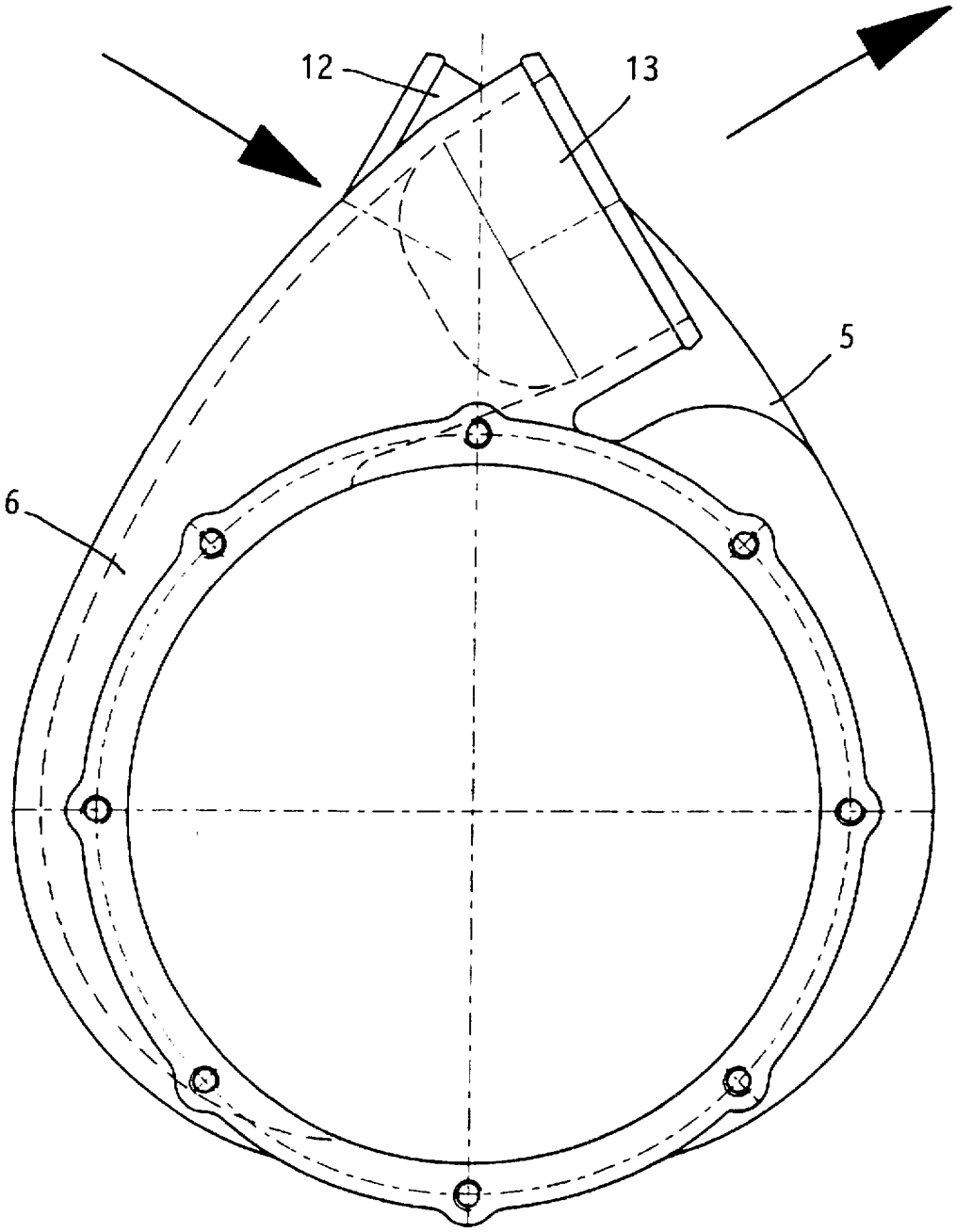
FIG. 3 A side view of the housing of the machine according to FIGS. 1 and 2.

The control of the gas pressure in the outlet channel 6 also takes place in the immediate vicinity of noise generation by a flow connection 19 and a control element 20 (FIG. 1), 21 (FIG. 5), or 22 (FIG. 6) provided therein and which is located in the vicinity of the side of the outlet channel 6 facing the housing space 11 and where, due to its configuration according to the invention, its outlet connection 13 extends over the inlet channel 5 (see FIG. 2). This area is located on the side of a central plane 24 of the single-piston machine including the inflow side or the inlet channel 5 and in which are located the rotation axes 25, 26 of the internal rotator 1 and the external rotor 2.

The flow connection 19 is formed by a short channel portion continuing the circumferential direction from the outlet channel 6 to that of the inlet channel 5. This provides a circular short-circuiting flow 6 and, as a result, this provides an optimum solution with respect to flow losses and noise generation. The flow losses are at a minimum solution with respect to flow losses and noise generation. The flow losses are at a minimum, because when the control element 20, 21, or 22 is in the open position, there is no pronounced flow deflection. The noise reduction is at an optimum, because the pressure waves in the gas flows are eliminated directly in the vicinity of the rotors 1, 2 due to the short-circuit of the flow between the inflow and outflow side and thus this design cannot act in the noise-generating manner found when long housing parts or connecting channels are used, such as is the case in DE-A-39 11 541. In addition, as a result of the construction according to the invention there is not increase in the size of the single-rotation machine housing or its overall, necessary installation space.

With the construction and arrangement of the control element 20 according to FIGS. 1 and 2 in the form of a drum controller parallel to the rotor axes 25, 26 for the laterally outer mounting of the drum controller only a short support stud 28 is provided and a shaft journal 29, which forms the connection with a control mechanism (not shown) projects laterally out of the side of the machine housing 11.

As can be gathered from the plan view of the single-piston machine according to FIG. 2, part of the flow indicated by the arrow 30 on approaching the outlet connection 13 is passed to the latter with an axial flow component. After passing through the flow connection 19 part of the flow is returned with a reversed axial component in the direction of the arrow 31 to the axial width of the inlet channel 5.

Figure 5:
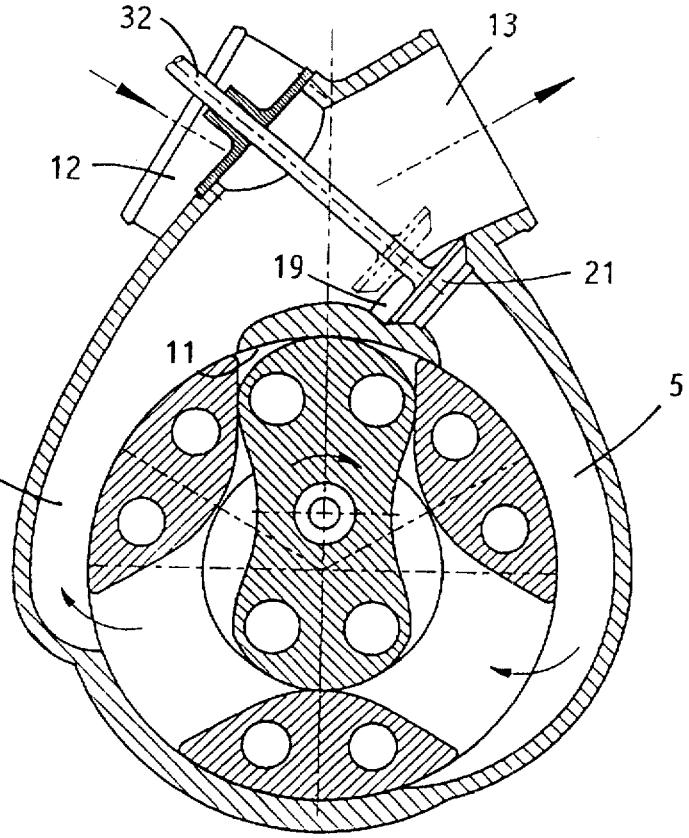
FIGS. 5 & 6 Views of the single-rotation machine corresponding to FIG. 1 with two different control device constructions.

In the embodiment according to FIG. 5 the control element is constructed as a disk valve. Its associated actuating shaft 32 projects out of the machine housing.

Figure 6:
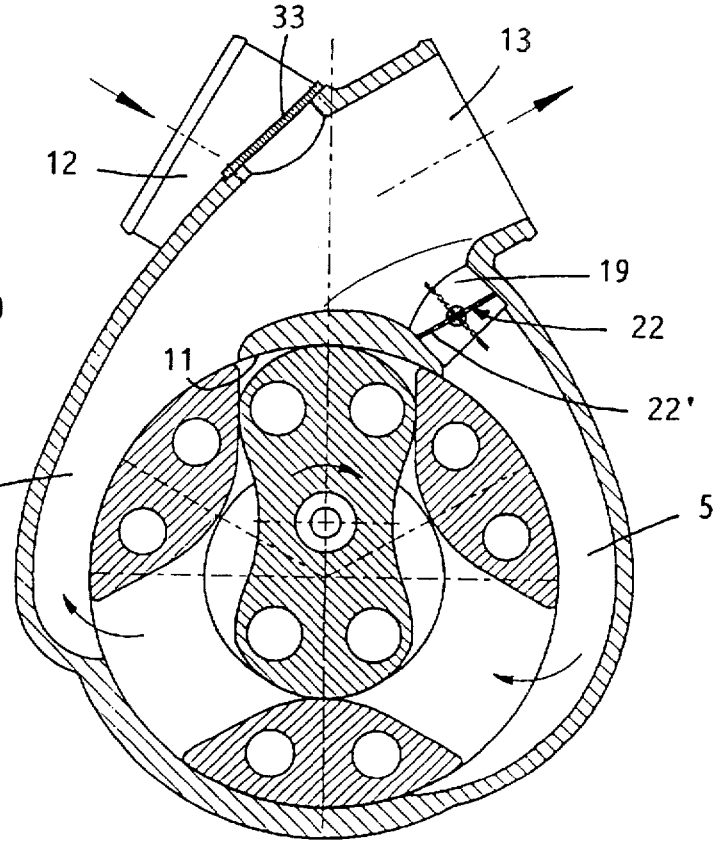

In the embodiment according to FIG. 6 the pressure control takes place by the return of part of the compressed or delivered gas from the outlet channel 6 into the inflow channel 5 by a control element 22 constructed as a throttle valve. Here again as a shaft journal carrying a flap 22' projects laterally out of the machine housing. In addition, on the side of the outlet channel 6 facing the control element 22 is fixed an assembly cover 33, which facilitates the assembly of the flap 22'.

What is claimed is:

1. A method of reducing noise from the flow of gaseous media in a rotary piston machine for compression of gaseous media, which machine uses a bypass for compression control, said method comprising the steps of:

locating inlet and outlet connections adjacent each other and tangentially with respect to rotors in said machine;

locating inlet and outlet channels in said machine leading to said inlet and outlet connections from working spaces within said machine, said inlet and outlet channels having arcuate configurations from said working spaces to the respective inlet and outlet connections; and disposing said bypass in a smooth arcuate path between said inlet and outlet channels in the immediate vicinity of said inlet and outlet connections.

2. The method of claim 1, further including the step of providing vanes in said inlet and outlet channels.

3. The method of claim 2, further including the step of arranging said inlet and outlet channels such that flow paths therein cross each other in the vicinity of said inlet and outlet connections with an angle defined by the flow paths in said channels where they cross each other, said angle being greater than 90° when facing said rotors.

4. The method of claim 1, further including the step of arranging said inlet and outlet channels such that flow paths therein cross each other in the vicinity of said inlet and outlet connections with an angle defined by the flow paths in said channels where they cross each other, said angle being greater than 90° when facing said rotors.

5. A method of reducing noise from the flow of gaseous media in a rotary piston machine used for supercharging combustion air in a motor vehicle, said machine having a bypass for compression control, said method comprising the steps of:

locating inlet and outlet connections adjacent each other and tangentially with respect to rotors in said machine;

locating inlet and outlet channels in said machine leading to said inlet and outlet connections from working spaces within said machine, said inlet and outlet channels having arcuate configurations from said working spaces to the respective inlet and outlet connections; and disposing said bypass in a smooth arcuate path between said inlet and outlet channels in the immediate vicinity of said inlet and outlet connections.

6. The method of claim 5, further including the step of providing vanes in said inlet and outlet channels.

7. The method of claim 6, further including the step of arranging said inlet and outlet channels such that flow paths therein cross each other in the vicinity of said inlet and outlet connections with an angle defined by the flow paths in said channels where they cross each other, said angle being greater than 90° when facing said rotors.

8. The method of claim 5, further including the step of arranging said inlet and outlet channels such that flow paths therein cross each other in the vicinity of said inlet and outlet connections with an angle defined by the flow paths in said channels where they cross each other, said angle being greater than 90° when facing said rotors.

* * * * *